US012660850B2

(12) United States Patent
Wu et al.

(10) Patent No.: US 12,660,850 B2
(45) Date of Patent: Jun. 23, 2026

(54) LIQUID-CONDUCTING ATOMIZATION MECHANISM AND ELECTRONIC ATOMIZER

(71) Applicant: SHENZHEN AEROSOL TECHNOLOGY RESEARCH CO., LTD., Shenzhen (CN)

(72) Inventors: Chengqin Wu, Shenzhen (CN); Hui Liu, Shenzhen (CN); Tongxing Fang, Shenzhen (CN); Xiong Jiang, Shenzhen (CN)

(73) Assignee: SHENZHEN AEROSOL TECHNOLOGY RESEARCH CO., LTD., Shenzhen (CN)

( * ) Notice: Subject to any disclaimer, the term of this patent is extended or adjusted under 35 U.S.C. 154(b) by 380 days.

(21) Appl. No.: 18/225,699

(22) Filed: Jul. 25, 2023

(65) Prior Publication Data

US 2024/0090570 A1 Mar. 21, 2024

Related U.S. Application Data

(63) Continuation of application No. PCT/CN2023/074011, filed on Jan. 31, 2023.

(30) Foreign Application Priority Data

Sep. 16, 2022 (CN) ..... 202211125935.3

(51) Int. Cl.
*A24F 40/10* (2020.01)
*A24F 40/40* (2020.01)
*A24F 40/46* (2020.01)

(52) U.S. Cl.
CPC ..... *A24F 40/10* (2020.01); *A24F 40/40* (2020.01); *A24F 40/46* (2020.01)

(58) Field of Classification Search
None
See application file for complete search history.

(56) References Cited

U.S. PATENT DOCUMENTS

2014/0246020 A1* 9/2014 Minskoff ..... A61M 11/042 261/142
2019/0350256 A1* 11/2019 Hejazi ..... A24F 40/44
(Continued)

FOREIGN PATENT DOCUMENTS

CN 104287098 A 1/2015
CN 204191592 U 3/2015
(Continued)

OTHER PUBLICATIONS

English machine translation of CN114259091A (Year: 2022).*
International Search Report of PCT Patent Application No. PCT/CN2023/074011 issued on Jun. 14, 2023.

*Primary Examiner* — Robert C Dye
(74) *Attorney, Agent, or Firm* — OPENPTO US LLC; Yuhao Liang

(57) ABSTRACT

A liquid-conducting atomization mechanism (10) includes a vertical ceramic member (100) and a heating screen plate assembly (200). the vertical ceramic member (100) includes a liquid receiving portion (110) and a liquid conduction mounting portion (120) that are connected to each other. Connection between the liquid conduction mounting portion (120) and the liquid receiving portion (110) is a connection plane. An atomization gas exit surface (122) is formed on an outside of the liquid conduction mounting portion (120). The heating screen plate assembly (200) includes a heating portion (210). The heating portion (210) is embedded in the atomization gas exit surface (122).

25 Claims, 17 Drawing Sheets

(56) References Cited

U.S. PATENT DOCUMENTS

| | | | | |
|---|---|---|---|---|
| 2022/0071290 | A1* | 3/2022 | Zhou | A24F 40/70 |
| 2022/0408815 | A1* | 12/2022 | Chen | A24F 40/44 |

FOREIGN PATENT DOCUMENTS

| | | | | |
|---|---|---|---|---|
| CN | 105433441 | A | | 3/2016 |
| CN | 205358219 | U | | 7/2016 |
| CN | 205456048 | U | | 8/2016 |
| CN | 114259091 | A | * | 4/2022 |
| CN | 216293032 | U | | 4/2022 |
| CN | 115381146 | A | | 11/2022 |
| CN | 218303453 | U | | 1/2023 |
| WO | 2022121611 | A1 | | 6/2022 |

* cited by examiner

LIQUID-CONDUCTING ATOMIZATION MECHANISM AND ELECTRONIC ATOMIZER

FIELD OF THE INVENTION

The present invention relates to a liquid-conducting atomization mechanism and an electronic atomizer.

DESCRIPTION OF THE RELATED ART

An atomization core of an electronic atomizer is a heating structure that includes a ceramic to serve as a mounting base, in order to heat and atomize an atomizable liquid into an aerosol. Based on the arrangement structure, the atomization cores are classified as a vertical ceramic atomization structure and a horizontal ceramic atomization structure. Among such structures, the vertical ceramic atomization structure often adopts a sidewall-liquid-feeding and center-gas-discharging manner. Such a vertical ceramic atomization structure suffers a drawback that condensate liquid or large liquid droplets generated by frying may be largely inhaled by a user to cause discomfort of the user, and also suffer dry burning.

To prevent the issues of frying and dry burning, as shown in FIG. 1, in a prior patent application CN2022109812767, a vertical ceramic atomization structure 50 in which a vertical ceramic 52 and a spiral heating filament 54 are integrally formed as a one piece structure is proposed, in which a turbulence is induced to avoid the drawback that the condensate liquid and the large liquid droplets generated by frying are largely inhaled by the user and also to speed up liquid feeding in order to prevent dry burning.

However, in the course of implementing the present invention, the present inventor finds the known techniques suffer at least the following problems: Since the spiral heating filament has only a portion exposed on an external wall of the vertical ceramic, while another portion is embedded in the vertical ceramic so that the spiral heating filament, when supplied with electrical power, shows a better effect of gas generation only on that exposed on the external wall of the vertical ceramic. This makes a relatively large amount of heat not efficiently acting on the external wall of the vertical ceramic, resulting in an issue that the vertical ceramic atomization structure suffers a great thermal loss. Further, a part of the spiral heating filament is located midway of a liquid conducting path of the vertical ceramic, namely located at a connecting site between a liquid-conducting projection 522 and a solid post 524 of the vertical ceramic 52. This makes the atomizable liquid not all conducted to a surface of the external wall of the vertical ceramic to atomize during a course of conducting the liquid in the vertical ceramic, resulting in an undesired situation of "liquid loss", thereby deteriorating the atomization performance of the vertical ceramic atomization structure.

SUMMARY OF THE INVENTION

In view of the above, it is desired to provide a liquid-conducting atomization mechanism and an electronic atomizer that effectively reduces the feeling of discomfort caused by frying during the use by a user and also effectively reduce dry burning and has a relatively small thermal loss and exhibits an excellent effect of atomization.

A liquid-conducting atomization mechanism comprises a vertical ceramic member and a heating screen plate assembly; the vertical ceramic member comprises a liquid receiving portion and a liquid conduction mounting portion that are connected to each other, and connection between the liquid conduction mounting portion and the liquid receiving portion is a connection plane, and an atomization gas exit surface is formed on an outside of the liquid conduction mounting portion; and the heating screen plate assembly comprises a heating portion, and the heating portion is embedded in the atomization gas exit surface.

An electronic atomizer comprises the liquid-conducting atomization mechanism descried in any of the above embodiments.

Details of one or multiple embodiments of the present invention will be introduced in the following drawings and description. Other features, objectives, and advantages of the present invention will become apparent from the disclosure, the drawings, and the claims.

BRIEF DESCRIPTION OF THE DRAWINGS

To more clearly expound the technical solution of embodiments of the present invention, as well as that of the prior art, a brief description will be provided below for the drawings that are necessary for the illustration of the embodiments of the present invention or that of the prior art. Obviously, the drawings described below show only some of the embodiments of the present invention, and those having ordinary skill in the art may envisage, based on the attached drawings, drawings of other embodiments without creative endeavor.

DETAILED DESCRIPTION OF PREFERRED EMBODIMENTS OF THE INVENTION

For better understanding of the present invention, the following provides a more comprehensive description of the present invention by taking reference to the attached drawings. However, the present invention can be embodied in various forms and is not limited to the embodiment described herein. On the contrary, the purpose of providing such embodiments is to allow the disclosed contents of the present invention to be understood in a more throughout manner. It is noted that when an element is referred to as being "fixed" on another element, it can be directly arranged on said another element or there can be an intermediate therebetween. When an element is referred to as being "connected" to another element, it can be directly connected to said another element or there can be an intermediate element therebetween. The terms "vertical", "horizontal", "left", and "right", and similar expressions as used herein are only for the purpose of illustration and are not intended to define a sole way of embodying. Unless otherwise defined, all the terminology and scientific terms used herein are of the same meaning as that commonly understood by the technicians of the art to which the invention belongs. The terminology used in the disclosure of the present invention is only adopted for the purposes of illustrating specific embodiments, and is not for limiting the present invention. The term "and/or" as used herein includes any and all combinations of one or more related items that are listed.

Figure 6:
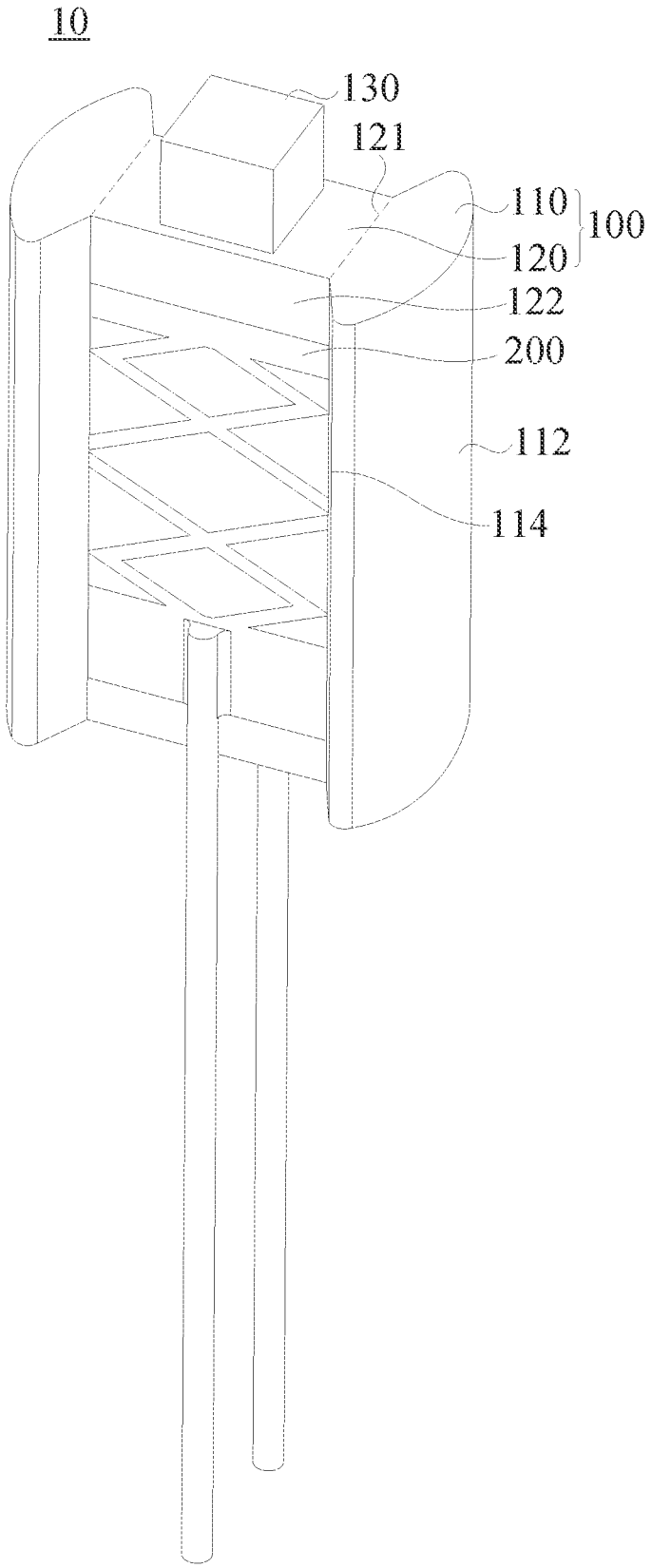
FIG. 6 is a schematic view showing a liquid-conducting atomization mechanism according to an embodiment of the present invention.
Figure 7:
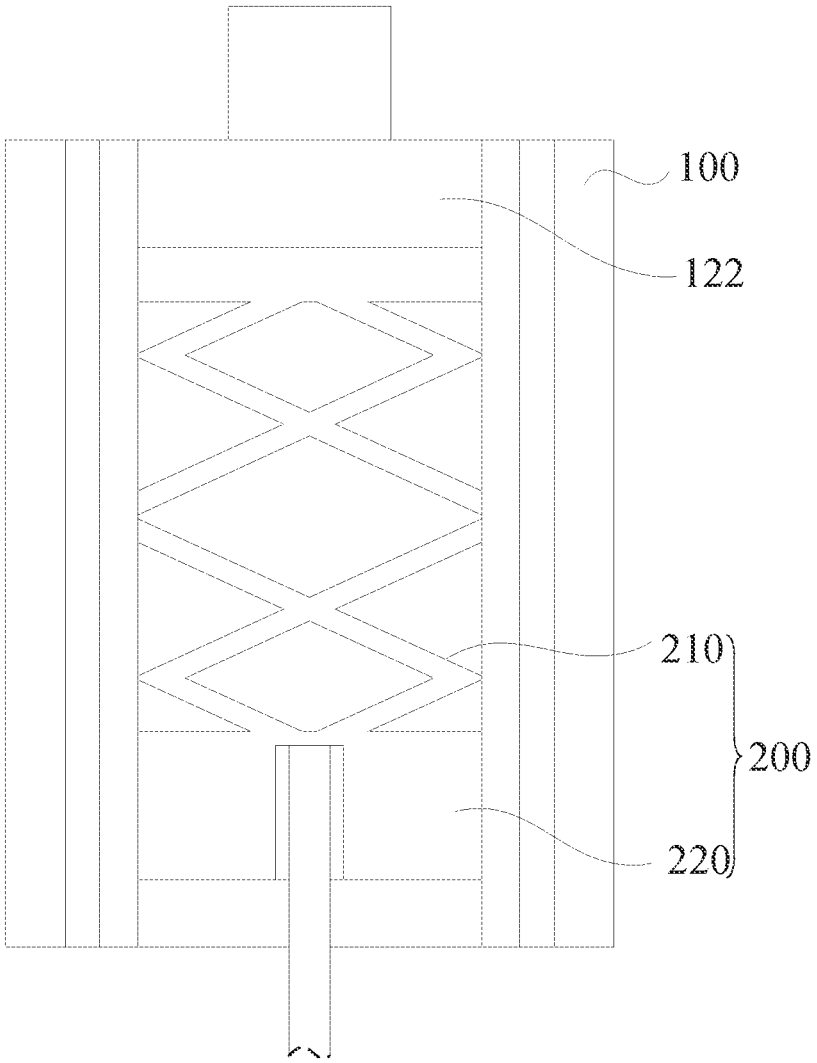
FIG. 7 is a schematic view, taken from another angle, showing the liquid-conducting atomization mechanism shown in FIG. 6.
Figure 8:
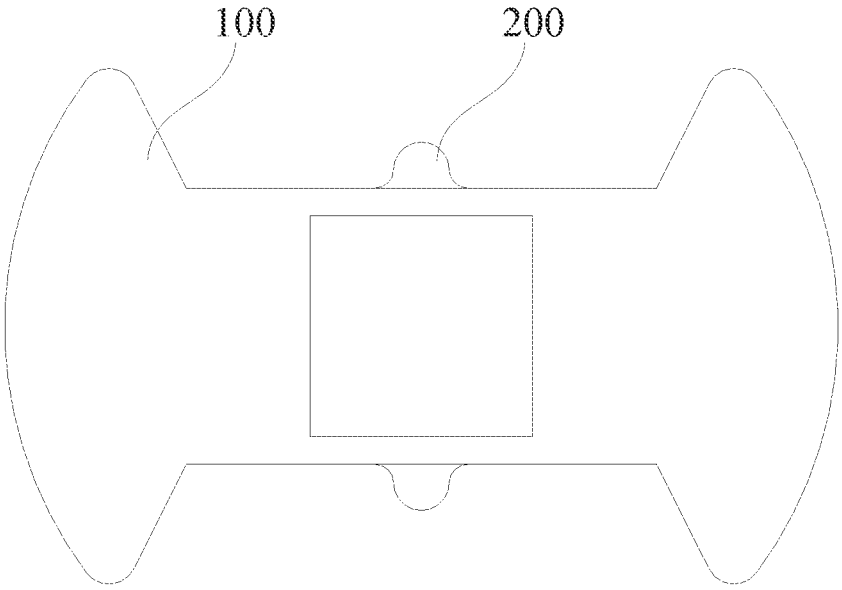
FIG. 8 is a schematic view, taken from a further angle, showing the liquid-conducting atomization mechanism shown in FIG. 6.

As shown in FIGS. 2-5, an electronic atomizer 20 according to an embodiment comprises a liquid-conducting atomization mechanism 10. As shown in FIGS. 6-8, the liquid-conducting atomization mechanism 10 comprises a vertical ceramic member 100 and a heating screen plate assembly 200. The vertical ceramic member 100 comprises a liquid receiving portion 110 and a liquid conduction mounting portion 120 that are connected to each other, and a connection between the liquid conduction mounting portion 120 and the liquid receiving portion 110 is a connection plane (wherein, in FIG. 6, a phantom line 121 is shown as a merging line between the connection plane and an end surface of the vertical ceramic member 100), so that a path along which an atomizable liquid flows from the liquid receiving portion 110 to the liquid conduction mounting portion 120 is made more linear to thereby shorten the path along which the atomizable liquid flows from the liquid receiving portion 110 to the liquid conduction mounting portion 120 to reduce the liquid loss that the atomizable liquid may have in the liquid conduction path in the vertical ceramic member 100.

Figure 1:
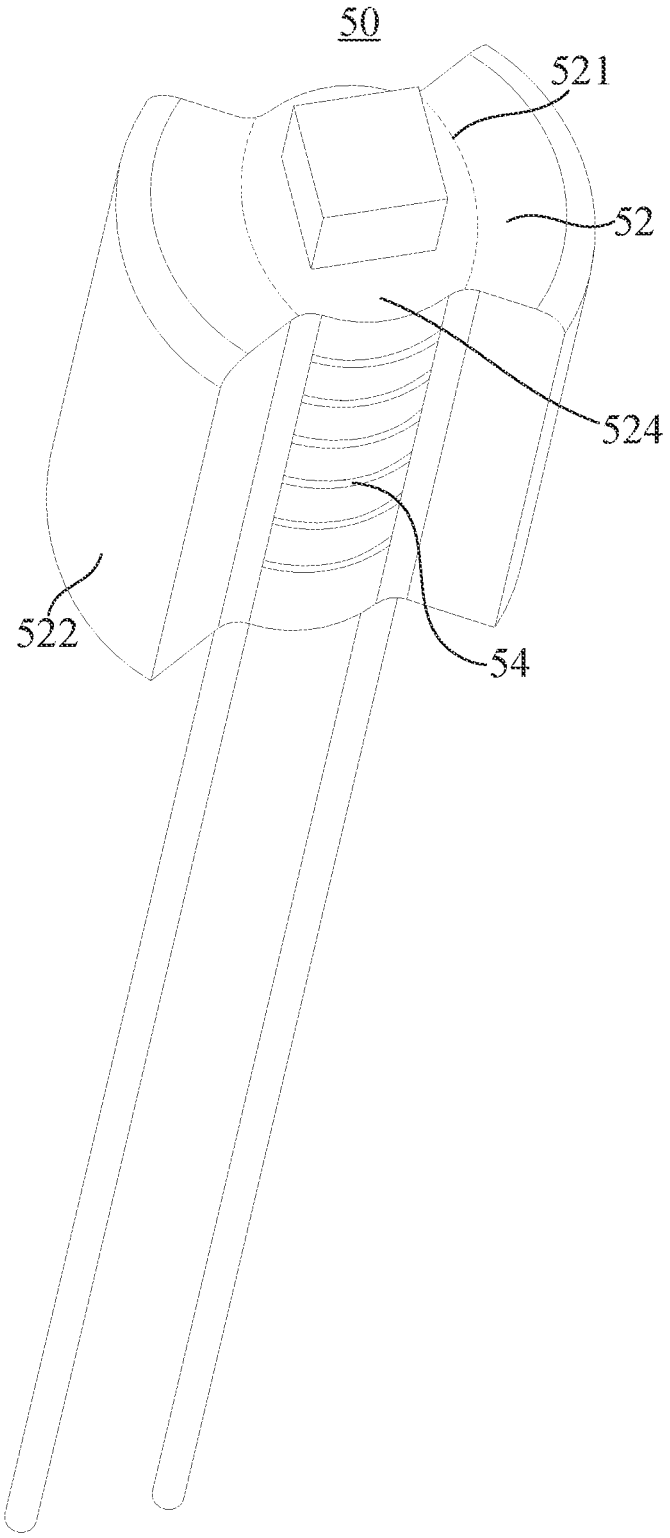
FIG. 1 is a schematic view showing a liquid-conducting atomization mechanism of a prior patent application.

It is noted that for the vertical ceramic atomization structure of Patent Application CN2022109812767, as shown in FIG. 1, since the spiral heating filament is integrally formed with the solid post to make the solid post 524 in a cylindrical form thereby making a connection site between the solid post and the liquid-conducting projection an arc surface (wherein, in FIG. 1, a phantom line 521 indicates a merging line between the arc surface and an end surface of the vertical ceramic 52), so that the liquid conduction path of the vertical ceramic atomization structure is relatively long. In the vertical ceramic member 100 of the liquid-conducting atomization mechanism 10 of the application, the connection between the liquid conduction mounting portion 120 and the liquid receiving portion 110 is a connection plane, so that the path along which the atomizable liquid flows from the liquid receiving portion 110 to the liquid conduction mounting portion 120 is made more linear and the liquid loss that the atomizable liquid may have in the liquid conduction path in the vertical ceramic member 100 is reduced.

As shown in FIGS. 6-8, in one embodiment, an atomization gas exit surface 122 is formed on an outside of the liquid conduction mounting portion 120, meaning the atomization gas exit surface 122 is arranged on an external circumferential wall of the liquid conduction mounting portion 120. Further, the atomization gas exit surface 122 is arranged to avoid the connection plane, namely the atomization gas exit surface 122 and the connection plane are not arranged coplanar with each other. In the instant embodiment, the atomization gas exit surface 122 is adjacent to the connection plane. In other embodiments, the atomization gas exit surface 122 can be arranged not adjacent to the connection plane. Further, the heating screen plate assembly 200 comprises a heating portion 210, and the heating portion 210 is embedded in the atomization gas exit surface 122, so as to allow the heating portion 210 to heat and atomize the atomizable liquid on the atomization gas exit surface 122. This allows the heating portion 210 to efficiently and effectively heat the atomizable liquid on the atomization gas exit surface 122 and reduce an undesired situation of "liquid loss" and enhance the atomization performance of the vertical ceramic atomization structure.

Figure 2:
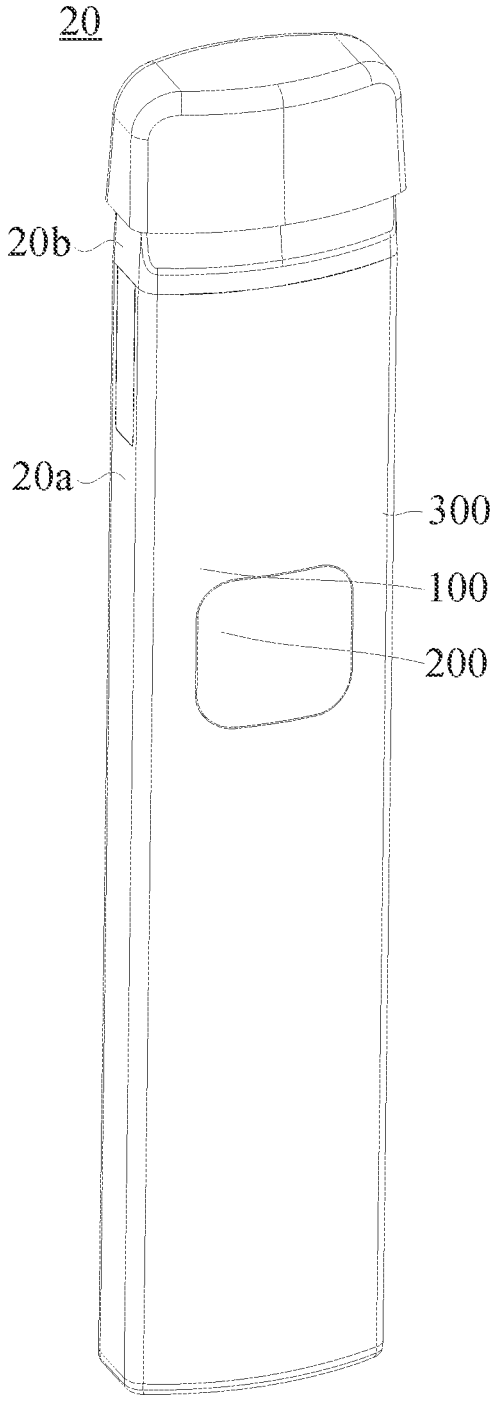
FIG. 2 is a schematic view showing an electronic atomizer according to an embodiment of the present invention.
Figure 3:
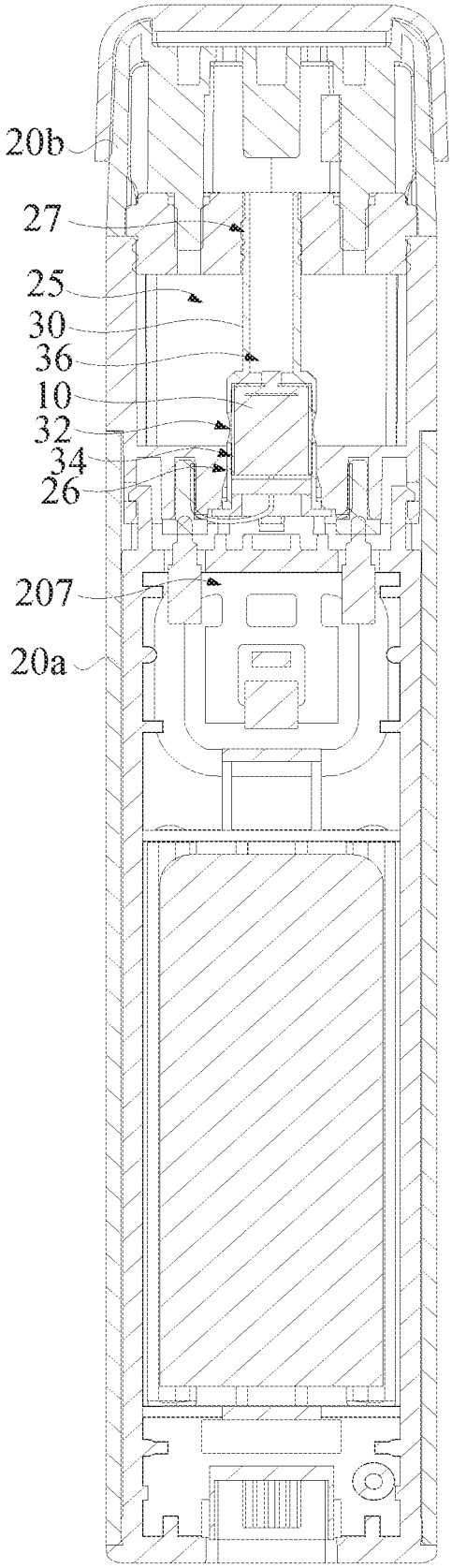
FIG. 3 is a cross-sectional view of the electronic atomizer shown in FIG. 2.
Figure 3A:
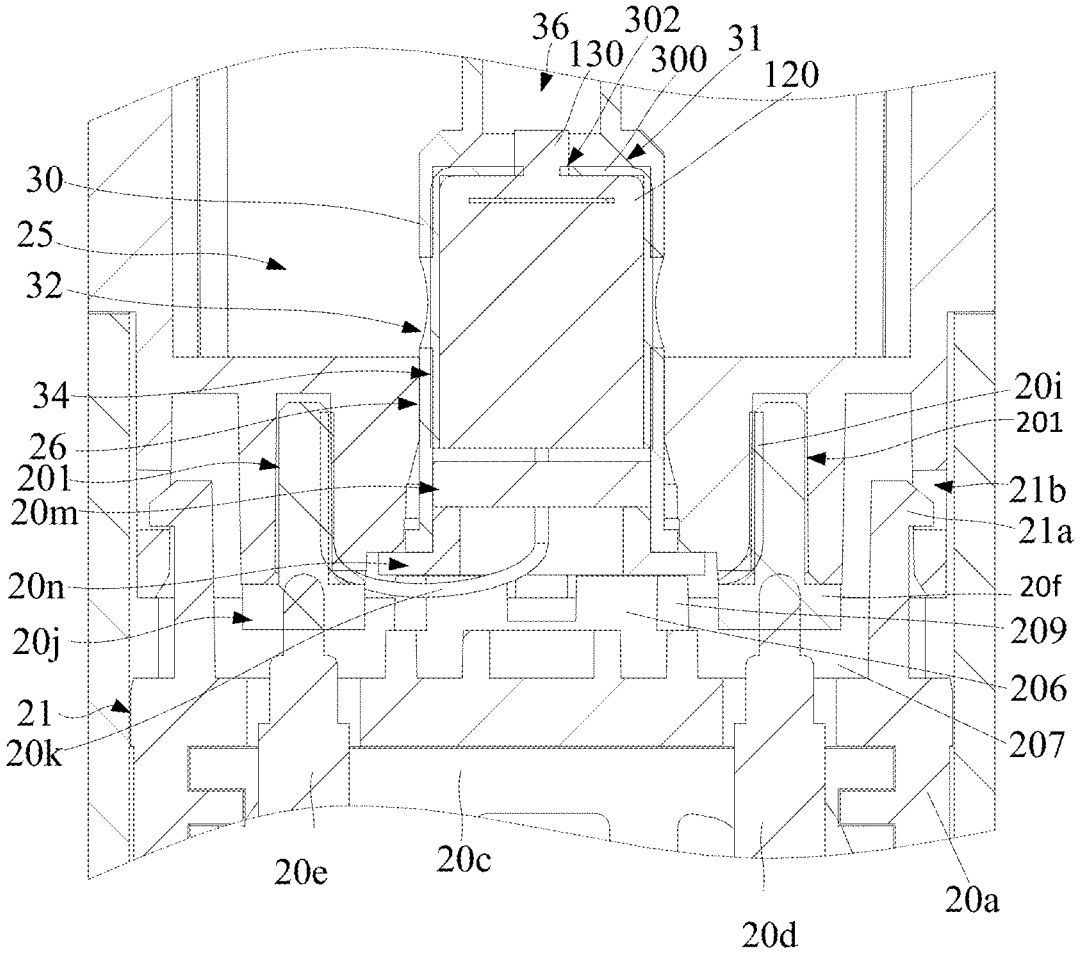
FIG. 3*a* is an enlarged view of the electronic atomizer shown in FIG. 3.
Figure 4:
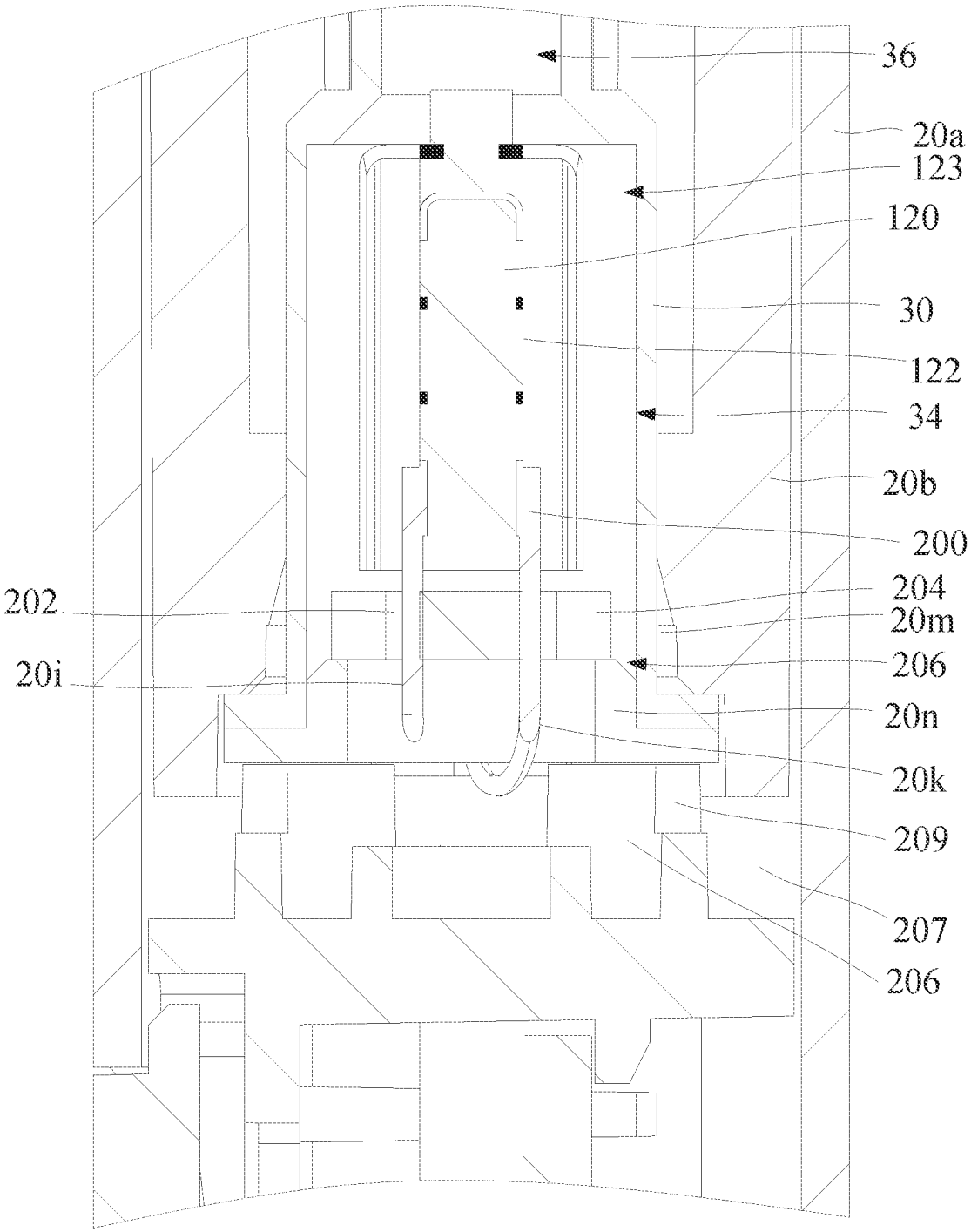
FIG. 4 is a cross-sectional view, taken from a different angle, of the electronic atomizer shown in FIG. 2.

As shown in FIGS. 2-4, further, the liquid-conducting atomization mechanism 10 is mounted in an internal chamber of the electronic atomizer 20, and one side of the liquid conduction mounting portion 120 that is on the atomization gas exit surface 122 encloses and defines, in combination with the internal chamber of the electronic atomizer 20, an atomization gas exit channel 123, and this avoids making an opening in a central position of the vertical ceramic member 100. In the instant embodiment, the liquid receiving portion 110, in the internal chamber of the electronic atomizer 20, is arranged to correspond a liquid exit hole 32 of a liquid storage member 20*b* of the electronic atomizer 20, and as such, the atomizable liquid flowing out of the liquid exit hole 32 of the liquid storage member 20*b* is allowed to get contact with an external wall of the liquid receiving portion 110 to allow the atomizable liquid to be conducted in reliably through the liquid receiving portion 110.

In the above-described electronic atomizer 20 and liquid-conducting atomization mechanism 10, the liquid receiving portion 110 is connected to the liquid conduction mounting portion 120, and the connection between the liquid conduction mounting portion 120 and the liquid receiving portion 110 is the connection plane, so that the atomizable liquid, after being conducted in through the liquid receiving portion 110, passes through the connection plane to efficiently transfer to the liquid conduction mounting portion 120, and in addition, the atomization gas exit surface 122 is arranged to avoid the connection plane, and the heating portion 210 is embedded in the atomization gas exit surface 122, so that the heating portion 210 is arranged to avoid the connection plane, and as such, the atomizable liquid conducted in through the liquid receiving portion 110 can be fully transferred to the atomization gas exit surface 122 for heating and atomizing, avoiding an undesired situation of "liquid loss" and better generating aerosol, to thereby enhance the atomization performance of the vertical ceramic atomization structure. Since the atomization gas exit surface 122 is arranged on an outside of the liquid conduction mounting portion 120, and the atomization gas exit surface 122 is arranged to avoid the connection plane, and the heating portion 210 is embedded in the atomization gas exit surface 122, in this way, the heating portion 210 is arranged to avoid the connection plane, and the heating portion 210 is completely exposed on a surface of the atomization gas exit surface 122, so that heat generated by the heating portion 210 can effectively act on the atomizable liquid on the atomization gas exit surface 122, and this, as compared to the arrangement of a spiral heating filament, can greatly reduce the issue of great thermal loss occurring in the vertical ceramic atomization structure.

As shown in FIGS. 3-4, further, the electronic atomizer 20 further comprises a central tube 30. The central tube 30 is formed with a liquid exit hole 32, a receiving compartment 34, and a gas exit passage 36. The receiving compartment 34 is in communication with the liquid exit hole 32 and the gas exit passage 36. The liquid-conducting atomization mechanism 10 is located in the receiving compartment 34 and is connected to the central tube 30 so as to have the liquid-conducting atomization mechanism 10 mounted in the internal chamber of the electronic atomizer 20. In the instant embodiment, the side of the liquid conduction mounting portion 120 on which the atomization gas exit surface 122 is arranged to enclose and define, in combination with an internal wall of the receiving compartment 34, an atomization gas exit channel 123. The atomization gas exit channel 123 is in communication with the gas exit passage 36, so that atomization gas generated in the atomization gas exit channel 123 can reliably flow out through the atomization gas exit channel 123. The liquid exit hole 32 is arranged to correspond to the liquid receiving portion 110, and the liquid exit hole 32 and the atomization gas exit channel 123 are arranged to avoid each other, so that the atomizable liquid may pass through the liquid exit hole 32 to reliably flow onto the liquid receiving portion 110.

As shown in FIGS. 3-4, further, the liquid-conducting atomization mechanism 10 is tightly connected to the central tube 30 to prevent any situation of leaking of the atomizable liquid, to have the atomizable liquid reliably flow onto the liquid receiving portion 110. Further, the liquid-conducting atomization mechanism 10 further comprises a liquid-conducting medium member 300, and the liquid-conducting medium member 300 is attached to surfaces of the liquid conduction mounting portion 120 and the liquid receiving portion 110, namely the liquid-conducting medium member 300 houses an external surface of the vertical ceramic member 100 to have the liquid-conducting atomization mechanism 10 tightly connected with the central tube 30, and also to have the atomizable liquid better transfer through the liquid-conducting medium member 300 to the external surface of the vertical ceramic member 100. Further, the liquid conduction mounting portion 120 and the liquid receiving portion 110 are of an integrally formed structure, and at least one the liquid conduction mounting portion 120 and the liquid receiving portion 110 is provided with a positioning post 130 so as to have the vertical ceramic member 100 better positioned and mounted in the internal chamber of the atomizer. The liquid-conducting medium member 300 is formed with a positioning hole 302, and the positioning post 130 extends through the positioning hole 302, and the liquid-conducting medium member 300 is positioned, by means of the positioning hole 302, on the positioning post 130 to have the liquid-conducting medium member 300 reliably attached to and positioned on the surface of the liquid conduction mounting portion 120 and the surface of the liquid receiving portion 110.

As shown in FIG. 6, further, the liquid conduction mounting portion 120, the liquid receiving portion 110, and the positioning post 130 are of an integrally formed structure. In the instant embodiment, the liquid-conducting medium member 300 comprises a liquid-conducting cotton member to provide the liquid-conducting medium member 300 with a better property of liquid conducting and cushioning. The liquid conduction mounting portion 120 and the liquid receiving portion 110 are set in elastically interference fit with the internal wall of the receiving compartment 34 by means of the liquid-conducting medium member 300 to also provide a better effect of preventing leaking of the atomizable liquid.

Figure 5:
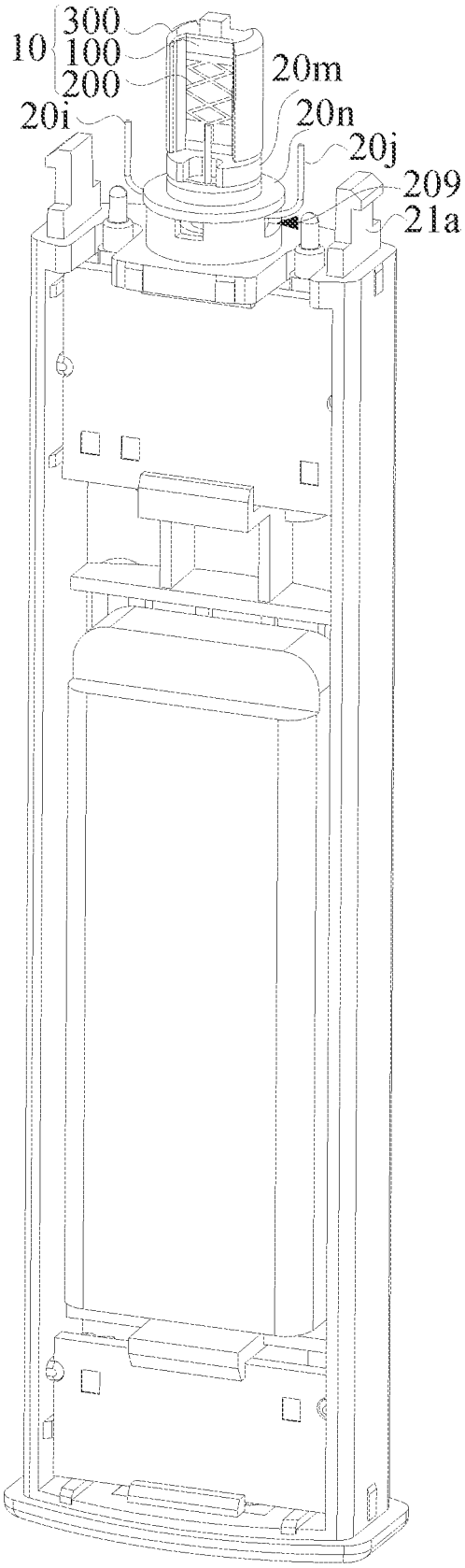
FIG. 5 is a schematic view showing a portion of the electronic atomizer shown in FIG. 2.
Figure 5A:
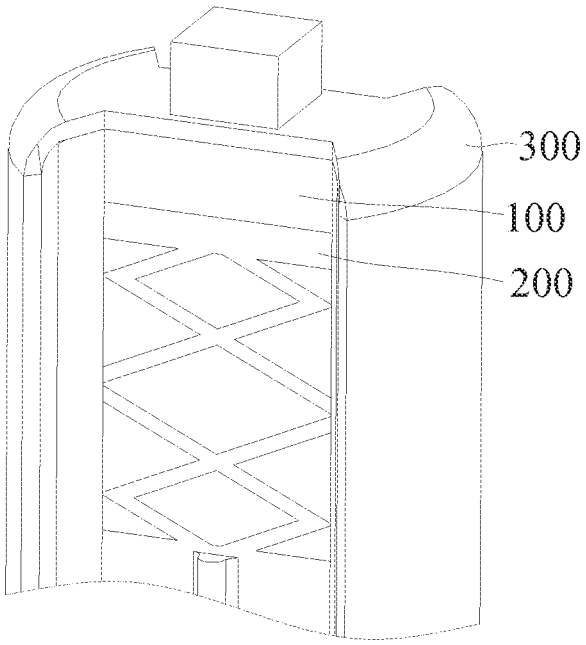
FIG. 5*a* is an enlarged view of a portion of the electronic atomizer shown in FIG. 5.

As shown in FIGS. 5 and 5*a*, further, the liquid-conducting medium member 300 has edges extending beyond edges of two sides of the external circumferential wall of the liquid receiving portion 110, so that with the liquid-conducting atomization mechanism 10 mounted in the interior of the receiving compartment 34, the liquid-conducting medium member 300 compressed and deformed due to interference fitting to thereby have the liquid-conducting medium member 300 reliably attached to the surface of the external circumferential wall of the liquid receiving portion 110, namely the liquid-conducting medium member 300 can reliably house the surface of the external circumferential wall of the liquid receiving portion 110 to provide a better effect of preventing leaking of the atomizable liquid.

It is appreciated that to prevent leaking of the atomizable liquid during the course of conducting, the liquid-conducting medium member 300 encloses and houses the external surface of the vertical ceramic member 100, and the vertical ceramic member 100 is tightly fit in the receiving compartment by means of the liquid-conducting medium member 300, making the communicability between the atomization gas exit channel 123 and the gas exit passage 36 poor. To avoid the issue that the communicability between the atomization gas exit channel 123 and the gas exit passage 36 becomes poor, as shown in FIGS. 3-4, further, the central tube 30 is also formed with a gas guiding trough 31, and the gas guiding trough 31 is in communication with the atomization gas exit channel 123, the receiving compartment 34, and the gas exit passage 36, so that the atomization gas generated in the atomization gas exit channel 123 may efficiently flow through the gas guiding trough 31 to the gas exit passage 36 to prevent, during the use of the electronic atomizer 20, a phenomenon of "choking", which is a situation where resistance to gas egress is greater, so as to enhance the atomization performance and gas egress performance of the atomization gas exit channel 123.

As shown in FIGS. 3-4, further, the gas guiding trough 31 has a diameter that is smaller than a diameter of the receiving compartment 34, and the diameter of the gas guiding trough 31 is greater than a diameter of the gas exit passage 36, so that the gas guiding trough 31 exhibits a better effect of gas egress and gas guiding. Further, an internal wall of the gas guiding trough 31 is provided with a gas guiding slope 312, and the gas guiding slope 312 is inclined at a preset angle. Further, the preset angle is 30°-65°, so that the internal wall of the gas guiding trough 31 exhibits a better effect of gas guiding.

As shown in FIGS. 3-4, further, the electronic atomizer 20 further comprises a battery post 20*a* and a liquid storage member 20*b*. The battery post 20*a* is formed with a sleeving opening 21, and an internal wall of the sleeving opening 21 is protruded to form a retaining engagement member 21*a*. One end of the liquid storage member 20*b* is located in the sleeving opening 21 and is fit to the battery post 20*a*, and an end portion of the liquid storage member 20*b* is formed with a retaining opening 21*b*. The retaining engagement member 21*a* is set in retaining engagement in the retaining opening 21*b* to have the liquid storage member 20*b* and the battery post 20*a* retained to and connected together. In the instant embodiment, the liquid storage member 20*b* is formed with a liquid storage compartment 25, a first sealing connection hole 26, and a second sealing connection hole 27. The liquid storage compartment 25 is in communication with the first sealing connection hole 26 and the second sealing connection hole 27. The central tube 30 extends into the first sealing connection hole 26 and the second sealing connection hole 27, and the central tube 30 is set in sealing connection with the liquid storage member 20*b*, so that the central tube 30 is reliably mounted to and connected with the liquid storage member 20*b*.

As shown in FIGS. 3-4, further, the electronic atomizer 20 further comprises a control panel 20*c*, a first electrically conductive spring pin 20*d*, and a second electrically conductive spring pin 20*e*. The control panel 20*c* is arranged on the battery post 20*a*. The first electrically conductive spring pin 20*d* and the second electrically conductive spring pin 20*e* are both fixedly connected to the control panel 20*c*, and the first electrically conductive spring pin 20*d* and the second electrically conductive spring pin 20*e* are both projecting beyond one end side of the control panel 20*c*. The first electrically conductive spring pin 20*d* is electrically connected to a positive conductive terminal of the heating screen plate assembly 200, and the second electrically conductive spring pin 20*e* is electrically connected to a negative conductive terminal of the heating screen plate assembly 200.

As shown in FIGS. 3-4, further, the electronic atomizer 20 further comprises a first wire-holding electrically conductive peg 20*f* and a first electrically conductive wire line 20*i*. An end portion of the liquid storage member 20*b* that is adjacent to the battery post 20*a* is formed with a first wire-holding assembling slot 201. One end of the first electrically conductive wire line 20*i* is received in the first wire-holding assembling slot 201, and the first wire-holding electrically conductive peg 20*f* is located in the first wire-holding assembling slot 201 and is fixedly connect to the liquid storage member, so that the first wire-holding electrically conductive peg 20*f* tightly press and hold the first electrically conductive wire line 20*i* in the first wire-holding assembling slot 201. An opposite end of the first electrically conductive wire line 20*i* is located in the central tube 30 and is soldered to the positive conductive terminal. The first electrically conductive spring pin 20*d* elastically abuts the first wire-holding electrically conductive peg 20*f*, so as to set the first electrically conductive spring pin 20*d* in electrical connection with the positive conductive terminal.

As shown in FIGS. 3-4, further, the electronic atomizer 20 further comprises a second wire-holding electrically conductive peg 20*j* and a second electrically conductive wire line 20*k*. An end portion of the liquid storage member 20*b* that is adjacent to the battery post 20*a* is formed with a second wire-holding assembling slot 203. One end of the second electrically conductive wire line 20*k* is received in the second wire-holding assembling slot 203, and the second wire-holding electrically conductive peg 20*j* is located in the second wire-holding assembling slot 203 and is fixedly connected to the liquid storage member 20*b*, so that the second wire-holding electrically conductive peg 20*j* tightly press and hold the second electrically conductive wire line 20*k* in the second wire-holding assembling slot 203. An opposite end of the second electrically conductive wire line 20*k* is located in the central tube 30 and is soldered to the negative conductive terminal. The second electrically conductive spring pin 20*e* elastically abuts the second wire-holding electrically conductive peg 20*j*, so as to set the second electrically conductive spring pin 20*e* in electrical connection with the negative conductive terminal.

As shown in FIGS. 3-4, further, the electronic atomizer 20 further comprises a liquid blocking plug 20*n*. The liquid blocking plug 20*n* is arranged adjacent to an end portion of the battery post 20*a*, and the liquid blocking plug 20*n* is located in the central tube 30 and is elastically connected to the central tube 30. An end portion of the liquid blocking plug 20*n* that is located in the central tube 30 and the internal wall of the central tube 30 jointly enclose and define a liquid collection trough 33 to collect and block the condensate liquid in order to prevent a situation of shorting the battery post 20*a* resulting from the condensate liquid leaking to the battery post 20*a*. In the instant embodiment, the liquid blocking plug 20*n* is formed with an overflow hole 205, and both the first electrically conductive wire line 20*i* and the second electrically conductive wire line 20*k* are both extended into the overflow hole 205 for mounting and extension of the first electrically conductive wire line 20*i* and the second electrically conductive wire line 20*k*, and also to have an airflow to better flow into the central tube 30. Specifically, the battery post 20*a* is formed, in an interior thereof, with a gas ingress flow passage 207, and the gas ingress flow passage 207 is in communication with the overflow hole 205 to have the airflow passing through the gas ingress flow passage 207 to flow into the overflow hole 205. Further, the electronic atomizer 20 further comprises a liquid absorption cotton 20*m*. The liquid absorption cotton 20*m* is located in the central tube 30 and is connected to the central tube 30, and the liquid absorption cotton 20*m* is set to abut the liquid blocking plug 20*n*. The liquid absorption cotton 20*m* is formed with a first flow-passing line-holding slot 202 and a second flow-passing line-holding slot 204. The first electrically conductive wire line 20*i* penetrates through the first flow-passing line-holding slot 202 to contact with the liquid absorption cotton 20*m*, and the second electrically conductive wire line 20*k* penetrates through the second flow-passing line-holding slot 204 to contact with the liquid absorption cotton 20*m*, so that the liquid absorption cotton 20*m* may position and isolate the first electrically conductive wire line 20*i* and the second electrically conductive wire line 20*k* to prevent the first electrically conductive wire line 20*i* and the second electrically conductive wire line 20*k* from contacting each other to cause an issue of shorting, and also, the liquid absorption cotton 20*m* provides an effect of absorbing the condensate liquid in the central tube 30 to achieve an effect of delaying and blocking the condensate liquid formed in the central tube 30 to thereby better prevent the situation of shorting of the battery post 20*a* resulting from the condensate liquid leaking to the battery post 20*a*.

As shown in FIGS. 3-4, further, the battery post 20*a* is formed, at a location corresponding to the overflow hole 205, with a liquid receiving trough 206. The overflow hole is located above the liquid receiving trough 206 so that in case that the condensate liquid passes through the overflow hole 205 to leak out, it will only fall into the interior of the liquid receiving trough 206 to thereby prevent the situation of shorting or even damage resulting from the condensate liquid leaking to other locations of the battery post 20*a*. Further, the battery post 20*a* is in contact engagement with the liquid blocking plug 20*n* to avoid an issue of the liquid blocking plug 20*n* accidently detaching from the central tube 30, and a gas passage slit 209 is formed in an end surface of the battery post 20*a*, and the gas passage slit 209 is in communication with the gas ingress flow passage 207 and the liquid receiving trough 206, so that an airflow may pass, in sequence, through the gas ingress flow passage 207, the gas passage slit 209, and the liquid receiving trough 206 to flow in to the overflow hole 205, and this not only realizes ingress of airflow, but also makes the condensate liquid in the liquid receiving trough 206 not easy to flow out.

As shown in FIGS. 6-7, in one embodiment, a surface of the heating portion 210 projects beyond a surface of the atomization gas exit surface 122, namely the surface of the heating portion 210 and the surface of the atomization gas exit surface 122 are not coplanar. It is appreciated that in other embodiments, the surface of the heating portion 210 is not limited to projecting beyond the surface of the atomization gas exit surface 122. For example, the surface of the heating portion 210 and the surface of the atomization gas exit surface 122 are located on the same surface, namely a portion of the heating portion 210 is embedded in the atomization gas exit surface 122.

As shown in FIGS. 6-8, in one embodiment, the liquid conduction mounting portion 120 and the liquid receiving portion 110 are made as an integrally formed structure, so as to have the liquid conduction mounting portion 120 and the liquid receiving portion 110 securely connected together and also to have the atomizable liquid better flowing from the liquid receiving portion 110 to the liquid conduction mounting portion 120 to reduce liquid loss occurring in the course of flowing of the atomizable liquid. Specifically, the liquid conduction mounting portion 120 and the liquid receiving portion 110 are formed through ceramic grouting integrally in-mold injection molding. It is appreciated that in other embodiments, the liquid conduction mounting portion 120 and the liquid receiving portion 110 are not limited to an integrally formed structure. For example, the liquid conduction mounting portion 120 and the liquid receiving portion 110 are molded separately, and the liquid conduction mounting portion 120 is soldered to the liquid receiving portion 110.

Figure 9:
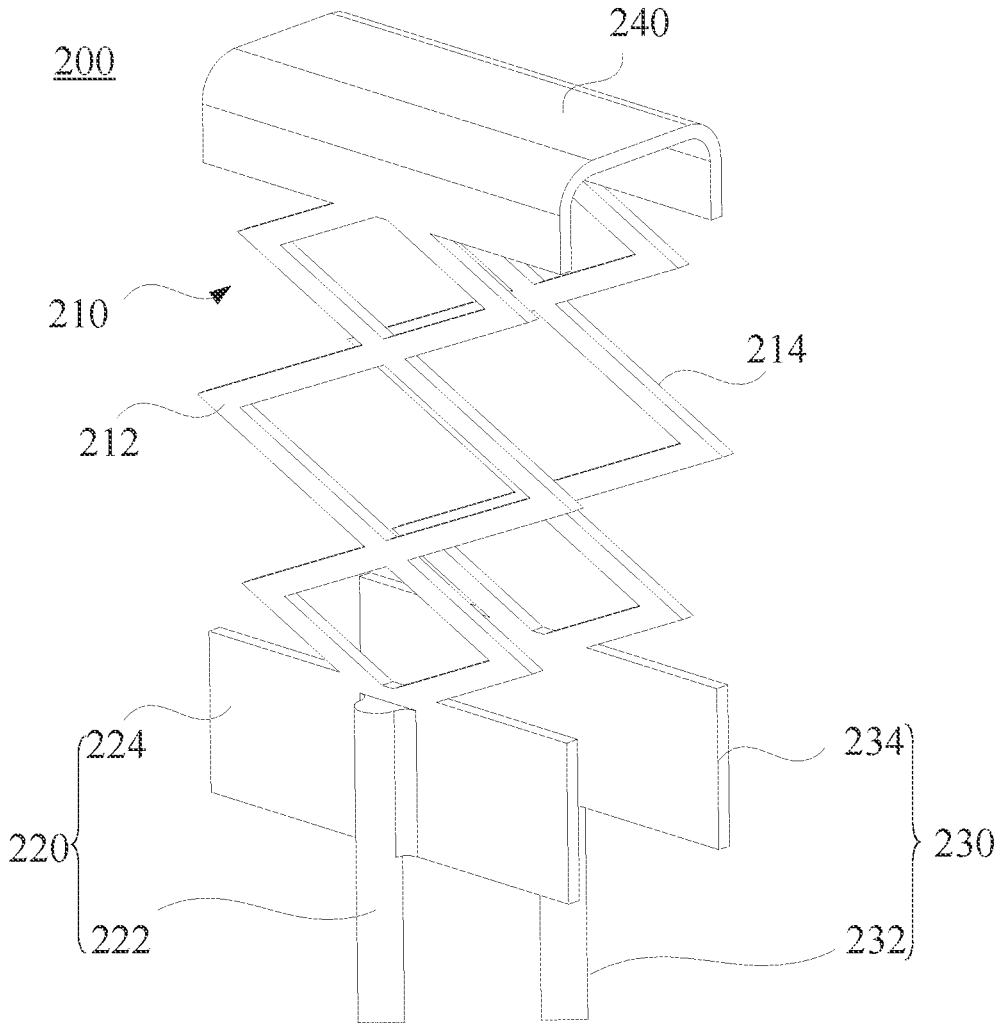
FIG. 9 is a schematic view showing a heating screen plate assembly of the liquid-conducting atomization mechanism shown in FIG. 6.
Figure 10:
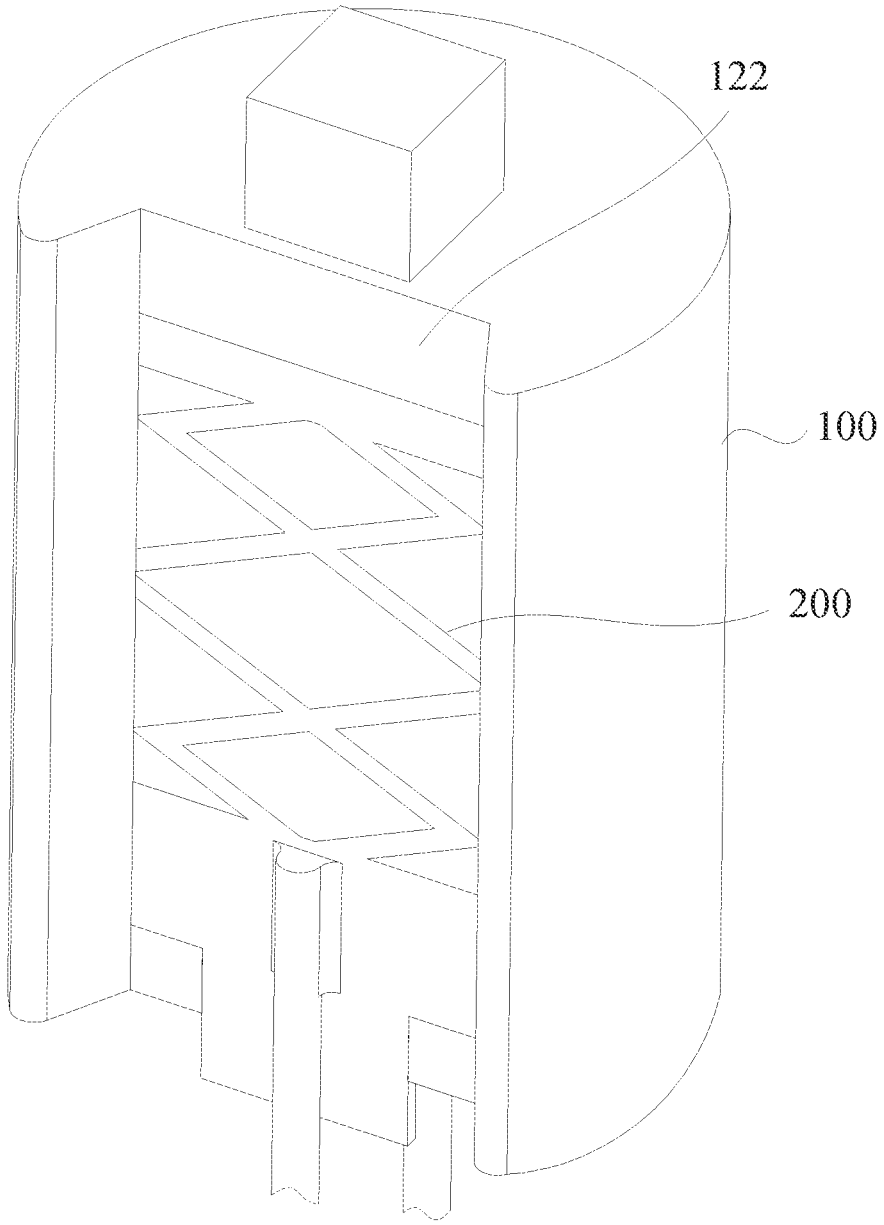
FIG. 10 is a schematic view showing a liquid-conducting atomization mechanism according to another embodiment of the present invention.
Figure 11:
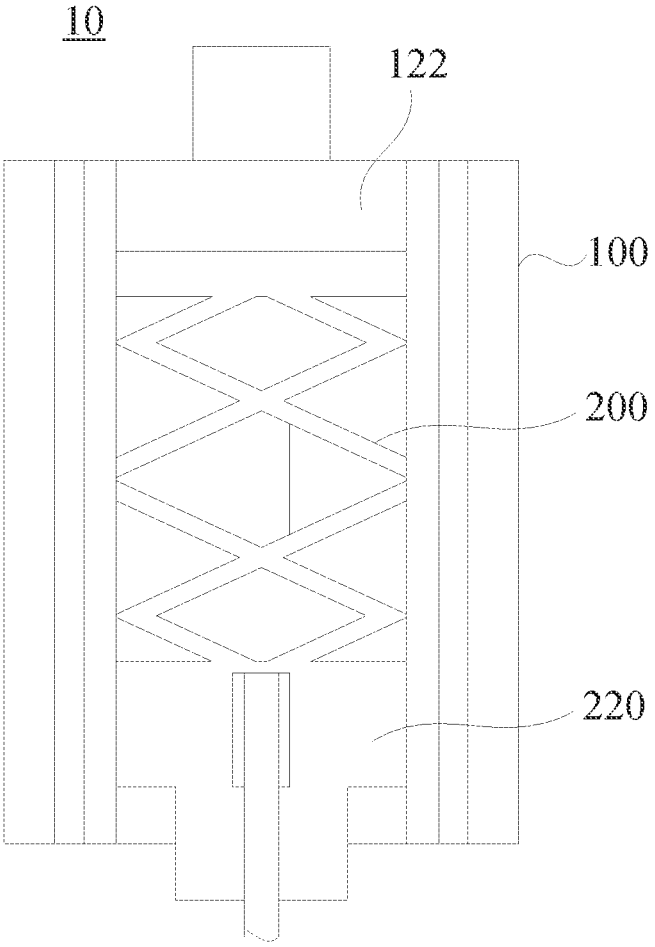
FIG. 11 is a schematic view, taken from another angle, showing the liquid-conducting atomization mechanism shown in FIG. 10.
Figure 12:
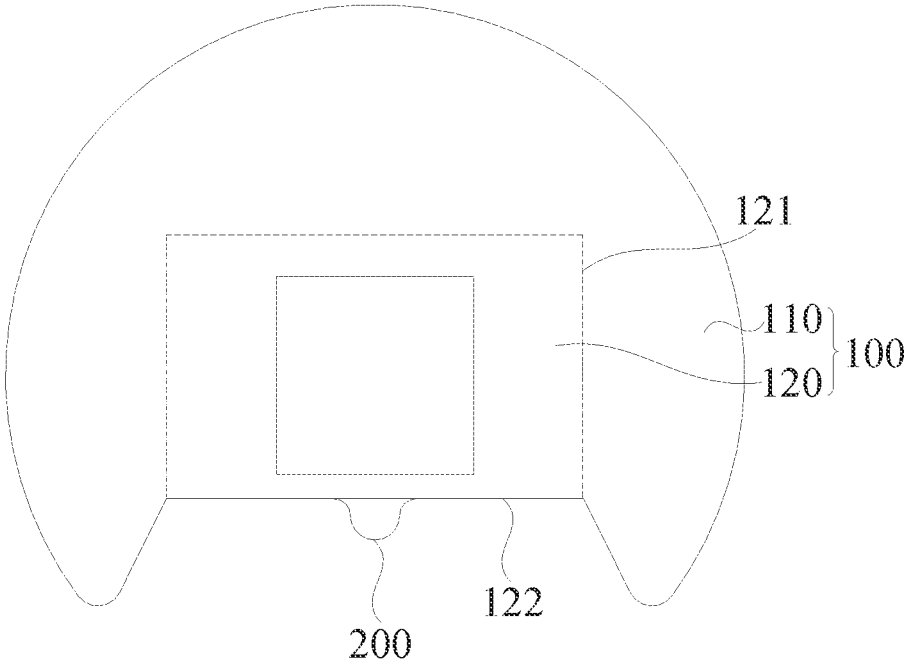
FIG. 12 is a schematic view, taken from a further angle, showing the liquid-conducting atomization mechanism shown in FIG. 10.

As shown in FIGS. 6, 8, and 9, in one embodiment, the liquid conduction mounting portion 120, the liquid receiving portion 110, and the heating screen plate assembly 200 are made as an integrally formed structure to have the liquid conduction mounting portion 120, the liquid receiving portion 110, and the heating screen plate assembly 200 securely connected together, and also to make the structure of the liquid-conducting atomization mechanism 10 compact. In the instant embodiment, the liquid conduction mounting portion 120, the liquid receiving portion 110, and the heating screen plate assembly 200 are of an integral in-mold injection molded structure.

As shown in FIGS. 10-13, in one embodiment, the heating screen plate assembly 200 comprises a first electrically conductive member 220, a second electrically conductive member 230, an intermediate electrically conductive member 240, and a heating portion 210. The first electrically conductive member 220 and one end of the intermediate electrically conductive member 240 are respectively connected to two ends of the heating portion 210 to have the first electrically conductive member 220 and the one end of the intermediate electrically conductive member 240 electrically connected to the two ends of the heating portion 210, respectively. The quantity of the heating portion 210 is at least one. Another end of the intermediate electrically conductive member 240 is connected to the second electrically conductive member 230 to have the heating portion 210 electrically connected by means of the intermediate electrically conductive member 240 to the second electrically conductive member 230. This reliably supplies electrical power to the heating portion 210 to generate heat. In the instant embodiment, the quantity of the heating portion 210 is one. Further, the intermediate electrically conductive member 240 is arranged adjacent to a first end of the vertical ceramic member 100, and the first electrically conductive member 220 and the second electrically conductive member 230 are both extended out of a second end of the vertical ceramic member 100 for external connection to conduct electricity. Specifically, the positive conductive terminal is arranged on the first electrically conductive member 220, and the negative conductive terminal is arranged on the second electrically conductive member 230.

It is appreciated that in other embodiments, the quantity of the heating portion 210 is not limited to one. As shown in FIGS. 6, 8, and 9, in another embodiment, the quantity of the heating portion 210 is two that are respectively a first heating portion 212 and a second heating portion 214. Two ends of the first heating portion 212 are respectively connected to the first electrically conductive member 220 and one end of the intermediate electrically conductive member 240, and two ends of the second heating portion 214 are respectively connected to the second electrically conductive member 230 and another end of the intermediate electrically conductive member 240. The quantity of the atomization gas exit surface 122 is two, and the first heating portion 212 and the second heating portion 214 are respectively embedded in the two atomization gas exit surfaces 122.

Figure 13:
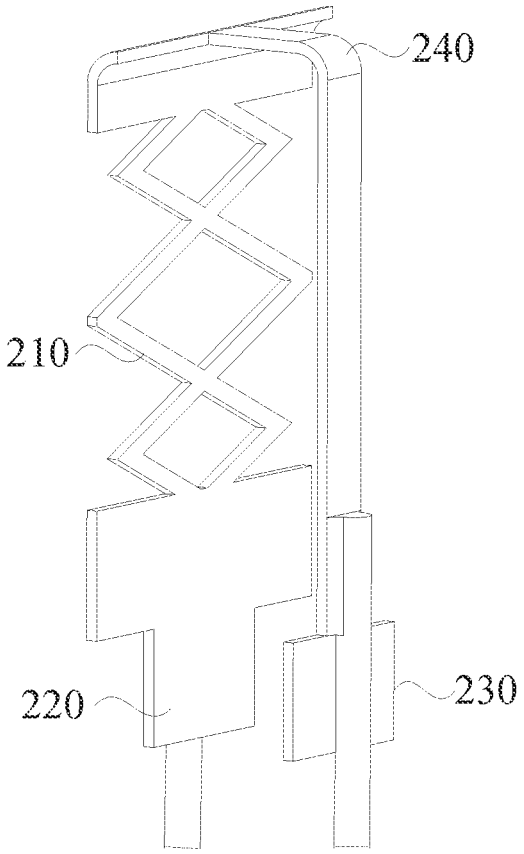
FIG. 13 is a schematic view showing a heating screen plate assembly of the liquid-conducting atomization mechanism shown in FIG. 10.

As shown in FIGS. 9 and 13, in one embodiment, the intermediate electrically conductive member 240 is set in a curved form to reduce the space occupied by the heating screen plate assembly 200 and to make the structure of the heating screen plate assembly 200 compact. In the instant embodiment, a fabrication method of the heating screen plate assembly 200 comprises: first subjecting the heating screen plate assembly 200 to stamping; and then bending the intermediate electrically conductive member 240 of the stamped heating screen plate assembly 200 to set the intermediate electrically conductive member 240 in a curved form.

As shown in FIGS. 9 and 13, in one embodiment, the heating screen plate assembly 200 is an integrally-formed stamped and bent structure, providing the heating screen plate assembly 200 with a better connection structure strength and also making the structure of the heating screen plate assembly 200 compact. It is appreciated that in other embodiments, the heating screen plate assembly 200 is not limited to an integrally-formed stamped and bent structure. For example, the first electrically conductive member 220, the second electrically conductive member 230, the intermediate electrically conductive member 240, and the heating portion 210 are molded separately and are securely connected together through soldiering.

In one embodiment, a fabrication method of the liquid-conducting atomization mechanism 10 comprises: first providing a metal plate; then subjecting the metal plate to an operation of stamping to form semi-finish product of the heating screen plate assembly 200 in a planar structure; then subjecting the semi-finish product of the heating screen plate assembly 200 to shaping through stamping and bending to form the heating screen plate assembly 200; then disposing and positioning the heating screen plate assembly 200 in an injection mold; and then pouring a ceramic paste into the injection mold for curing to form an integrally-formed structure of the liquid conduction mounting portion 120, the liquid receiving portion 110, and the heating screen plate assembly 200.

As shown in FIG. 9, in one embodiment, the first electrically conductive member 220 comprises a first electrically conductive strip 222 and a first electrically conductive plate 224. The first electrically conductive strip 222 is soldered to the first electrically conductive plate 224 to have the first electrically conductive strip 222 and the first electrically conductive plate 224 reliably and electrically connected together. In one embodiment, the second electrically conductive member 230 comprises a second electrically conductive strip 232 and a second electrically conductive plate 234. The second electrically conductive strip 232 is soldered to the second electrically conductive plate 234 to have the second electrically conductive strip 232 and the second electrically conductive plate 234 reliably and electrically connected together. In one embodiment, after the step of subjecting the heating screen plate assembly 200 to stamping and before a step of subjecting the intermediate electrically conductive member 240 of the heating screen plate assembly 200 to bending, the fabrication method of the heating screen plate assembly 200 further comprises: soldering the first electrically conductive strip 222 to the first electrically conductive plate 224, and soldering the second electrically conductive strip 232 to the second electrically conductive plate 234.

Figure 14:
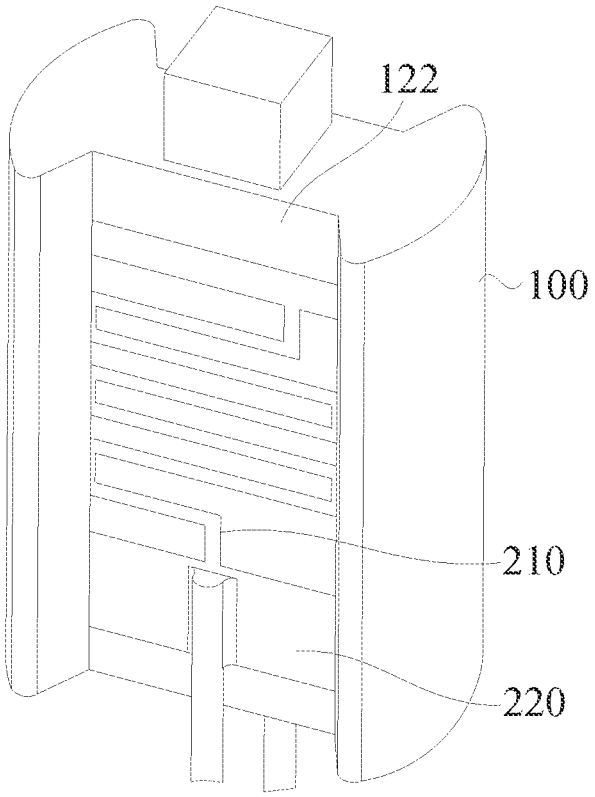
FIG. 14 is a schematic view showing a liquid-conducting atomization mechanism according to a further embodiment of the present invention.
Figure 15:
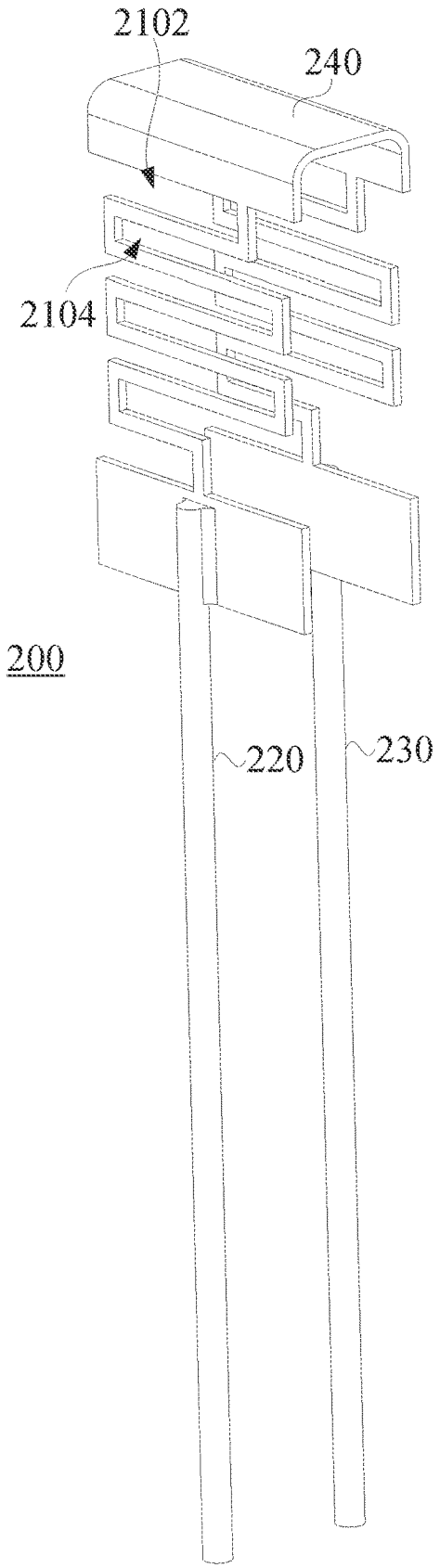
FIG. 15 is a schematic view showing a heating screen plate assembly of the liquid-conducting atomization mechanism shown in FIG. 14.

As shown in FIG. 9, in one embodiment, the heating portion 210 comprises a heating screen plate structure, so as to have the heating portion 210 better heat and atomize the atomizable liquid on the atomization gas exit surface 122. In one embodiment, the heating portion 210 comprises a rhombus grating structure to provide the heating portion 210 with a better effect of heating and atomizing. In other embodiments, the heating portion 210 is not limited to the rhombus grating structure. As shown in FIGS. 14 and 15, for example, the heating portion 210 is formed with multiple first hollowed zones 2102 and multiple second hollowed zones 2104. Each of the first hollowed zones 2102 is arranged adjacent to a corresponding one of the second hollowed zones 2104 so that two adjacent ones of the first hollowed zones 2102 are separated by the second hollowed zone 2104. Each of the first hollowed zones 2102 is arranged to shift in location relative to a corresponding one of the second hollowed zones 2104 to allow the thermal energy of the heating screen plate structure to effectively act on the atomizable liquid on the atomization gas exit surface 122 and also to allow the aerosol generated on the atomization gas exit surface 122 to efficiently flow out to thereby enhance the atomization egress performance of the liquid-conducting atomization mechanism 10.

As shown in FIG. 6, in one embodiment, the quantity of the liquid receiving portion 110 is two that are respectively a first liquid receiving portion 112 and a second liquid receiving portion 114. The first liquid receiving portion 112 and the second liquid receiving portion 114 are respectively connected to two ends of the liquid conduction mounting portion 120. The quantity of the atomization gas exit surface 122 and the heating portion 210 are each two, and the two heating portions 210 are respectively embedded in the corresponding ones of the atomization gas exit surfaces 122 to enhance the liquid-conducting and atomizing efficiency of the liquid-conducting atomization mechanism 10. In the instant embodiment, the first liquid receiving portion 112 and the second liquid receiving portion 114 are arranged opposite to each other on two sides of the liquid conduction mounting portion 120. In other embodiments, the quantity of the liquid receiving portion 110 is not limited to two and may be three or other numbers.

Compared to the known techniques, the present invention provides at least the following advantages:

(1) In the above liquid-conducting atomization mechanism 10, the liquid receiving portion 110 is connected to the liquid conduction mounting portion 120, and the connection between the liquid conduction mounting portion 120 and the liquid receiving portion 110 is a connection plane so that the atomizable liquid, after being conducted in through the liquid receiving portion 110, can pass through the connection plane to efficiently transfer to the liquid conduction mounting portion 120, and in addition, the heating portion 210 is embedded in the atomization gas exit surface 122 to have the heating portion 210 arranged to avoid the connection plane, so that the atomizable liquid conducted in through the liquid receiving portion 110 can be fully transferred to the atomization gas exit surface 122 to be heated and atomized, avoiding an undesired situation of "liquid loss" to better generate aerosol to thereby enhance the atomization performance of the vertical ceramic atomization structure.

(2) The atomization gas exit surface 122 is arranged on an outside of the liquid conduction mounting portion 120 and the heating portion 210 is embedded in the atomization gas exit surface 122, and this makes the heating portion 210 arranged in a manner of avoiding the connection plane to allow the heating portion 210 to completely expose on a surface of the atomization gas exit surface 122, and as such, the heat generated by the heating portion 210 to effectively act on the atomizable liquid on the atomization gas exit surface 122, and this, as compared to the arrangement of a spiral heating filament, can greatly reduce the issue of great thermal loss occurring in the vertical ceramic atomization structure.

All the features of the embodiments described above can be combined arbitrarily, and for simplicity of the description, all possible combinations of the features of the above embodiments have been expounded. However, all the combinations of such features are all considered within the scope of the disclosure provided there is no contradiction between such features. The above-discussed embodiments only illustrate some of the embodiments of the present invention. The illustration is made specific and detailed, and it should not be construed as being limitative to the scope of protection of the present invention. It is noted that for those having ordinary skill in the art, various changes and modifications can be contemplated without departing from the inventive idea of the present invention, and such are all considered within the scope of protection of the present invention. Thus, the scope of patent protection of the present invention is only defined by the appended claims.

What is claimed is:

1. A liquid-conducting atomization mechanism, comprising a vertical ceramic member and a heating screen plate assembly, wherein the vertical ceramic member comprises a liquid receiving portion and a liquid conduction mounting portion that are connected to each other, and connection between the liquid conduction mounting portion and the liquid receiving portion is a connection plane, and an atomization gas exit surface is formed on an outside of the liquid conduction mounting portion; and the heating screen plate assembly comprises a heating portion which is embedded in the atomization gas exit surface;

wherein the liquid-conducting atomization mechanism further comprises a liquid-conducting medium member, and the liquid-conducting medium member is attached to surfaces of the liquid conduction mounting portion and the liquid receiving portion; and wherein the liquid conduction mounting portion and the liquid receiving portion are made as an integrally-formed structure, and at least one of the liquid conduction mounting portion and the liquid receiving portion is formed with a positioning post, and the liquid-conducting medium member is formed with a positioning hole, the positioning post being received in the positioning hole.

2. The liquid-conducting atomization mechanism according to claim 1, wherein the liquid conduction mounting portion and the liquid receiving portion are made as an integrally-formed structure.

3. The liquid-conducting atomization mechanism according to claim 2, wherein the liquid conduction mounting portion, the liquid receiving portion, and the heating screen plate assembly are made as an integrally-formed structure.

4. The liquid-conducting atomization mechanism according to claim 1, wherein the heating screen plate assembly comprises a first electrically conductive member, a second electrically conductive member, an intermediate electrically conductive member, and a heating portion, the first electrically conductive member and one end of the intermediate electrically conductive member being respectively connected to two ends of the heating portion, the number of the heating portion being at least one, another end of the intermediate electrically conductive member being connected to the second electrically conductive member.

5. The liquid-conducting atomization mechanism according to claim 4, wherein the number of the heating portion is two that are respectively a first heating portion and a second heating portion; two ends of the first heating portion are respectively connected to the first electrically conductive member and one end of the intermediate electrically conductive member, and two ends of the second heating portion are respectively connected to the second electrically conductive member and another end of the intermediate electrically conductive member; and the number of the atomization gas exit surface is two, and the first heating portion and the second heating portion are respectively embedded in the two atomization gas exit surfaces.

6. The liquid-conducting atomization mechanism according to claim 4, wherein the intermediate electrically conductive member is in a curved form.

7. The liquid-conducting atomization mechanism according to claim 4, wherein the heating screen plate assembly is an integrally-formed stamped and bent structure.

8. The liquid-conducting atomization mechanism according to claim 4, wherein the intermediate electrically conductive member is in a curved form, and the heating screen plate assembly is an integrally-formed stamped and bent structure.

9. The liquid-conducting atomization mechanism according to claim 4, wherein the first electrically conductive member comprises a first electrically conductive strip and a first electrically conductive plate, and the first electrically conductive strip is soldered to the first electrically conductive plate; and the second electrically conductive member comprises a second electrically conductive strip and a second electrically conductive plate, and the second electrically conductive strip is soldered to the second electrically conductive plate.

10. The liquid-conducting atomization mechanism according to claim 1, wherein the heating portion comprises a heating screen plate structure.

11. The liquid-conducting atomization mechanism according to claim 1, wherein the heating portion is formed with multiple first hollowed zones and multiple second hollowed zones, and each of the first hollowed zones is arranged adjacent to a corresponding one of the second hollowed zones, and each of the first hollowed zones is arranged to shift in position relative to the corresponding one of the second hollowed zones.

12. The liquid-conducting atomization mechanism according to claim 1, wherein the atomization gas exit surface is arranged to avoid the connection plane.

13. The liquid-conducting atomization mechanism according to claim 1, wherein the number of the liquid receiving portion is two that are respectively a first liquid receiving portion and a second liquid receiving portion, and the first liquid receiving portion and the second liquid receiving portion are respectively connected to two ends of the liquid conduction mounting portion; and the numbers of the atomization gas exit surface and the heating portion are both two and the two heating portions are respectively embedded in corresponding ones of the atomization gas exit surfaces.

14. The liquid-conducting atomization mechanism according to claim 13, wherein the first liquid receiving portion and the second liquid receiving portion are arranged opposite to each other on two sides of the liquid conduction mounting portion.

15. An electronic atomizer, comprising the liquid-conducting atomization mechanism according to claim 1.

16. The electronic atomizer according to claim 15, wherein the liquid-conducting atomization mechanism is mounted in an internal chamber of the electronic atomizer, and one side of the liquid conduction mounting portion on the atomization gas exit surface defines, in combination with the internal chamber of the electronic atomizer, an atomization gas exit channel.

17. The electronic atomizer according to claim 16, further comprising a central tube, wherein the central tube is formed with a liquid exit hole, a receiving compartment, and a gas exit passage, the receiving compartment being in communication with the liquid exit hole and the gas exit passage, the liquid-conducting atomization mechanism being located in the receiving compartment and connected to the central tube, the side of the liquid conduction mounting portion on the atomization gas exit surface being arranged to enclose and define, in combination with an internal wall of the receiving compartment, an atomization gas exit channel; and the atomization gas exit channel is in communication with the gas exit passage, and the liquid exit hole is arranged to correspond to the liquid receiving portion, and the liquid exit hole and the atomization gas exit channel are arranged to avoid each other.

18. The electronic atomizer according to claim 17, wherein the liquid-conducting atomization mechanism is tightly connected to the central tube.

19. The electronic atomizer according to claim 18, wherein the central tube is formed with a gas guiding trough, and the gas guiding trough is in communication with the atomization gas exit channel, the receiving compartment, and the gas exit passage.

20. The electronic atomizer according to claim 19, wherein the gas guiding trough has a diameter that is smaller than a diameter of the receiving compartment, and the diameter of the gas guiding trough is greater than a diameter of the gas exit passage.

21. The electronic atomizer according to claim 19, wherein an internal wall of the gas guiding trough is provided with a gas guiding slope, and the gas guiding slope is inclined relative to a central axis of the gas guiding trough at a preset angle; and the preset angle is 30°-65°; and the electronic atomizer further comprises a battery post and a liquid storage member, the battery post being formed with a sleeving opening, and an internal wall of the sleeving opening is protruded to form a retaining engagement member, one end of the liquid storage member being located in the sleeving opening and fit to the battery post, an end portion of the liquid storage member being formed with a retaining opening, the retaining engagement member being set in retaining engagement in the retaining opening; the liquid storage member is formed with a liquid storage compartment, a first sealing connection hole, and a second sealing connection hole, and the liquid storage compartment is in communication with the first sealing connection hole and the second sealing connection hole; and the central tube extends into the first sealing connection hole and the second sealing connection hole, and the central tube is set in sealing connection with the liquid storage member.

22. The electronic atomizer according to claim 21, wherein the electronic atomizer further comprises a control panel, a first electrically conductive spring pin, and a second electrically conductive spring pin, the control panel being arranged on the battery post, the first electrically conductive spring pin and the second electrically conductive spring pin being both fixedly connected to the control panel, the first electrically conductive spring pin and the second electrically conductive spring pin both projecting beyond one end side of the control panel; and the first electrically conductive spring pin is electrically connected to a positive conductive terminal of the heating screen plate assembly, and the second electrically conductive spring pin is electrically connected to a negative conductive terminal of the heating screen plate assembly.

23. The electronic atomizer according to claim 22, wherein the electronic atomizer further comprises a first wire-holding electrically conductive peg and a first electrically conductive wire line, and an end portion of the liquid storage member that is adjacent to the battery post is formed with a first wire-holding assembling slot, and one end of the first electrically conductive wire line is received in the first wire-holding assembling slot, and the first wire-holding electrically conductive peg is located in the first wire-holding assembling slot and is fixedly connect to the liquid storage member, and an opposite end of the first electrically conductive wire line is located in the central tube and is soldered to the positive conductive terminal, the first electrically conductive spring pin elastically abutting the first wire-holding electrically conductive peg; and the electronic atomizer further comprises a second wire-holding electrically conductive peg and a second electrically conductive wire line, and the end portion of the liquid storage member that is adjacent to the battery post is formed with a second wire-holding assembling slot, and one end of the second electrically conductive wire line is received in the second wire-holding assembling slot, and the second wire-holding electrically conductive peg is located in the second wire-holding assembling slot and is fixedly connect to the liquid storage member, and an opposite end of the second electrically conductive wire line is located in the central tube and is soldered to the negative conductive terminal, the second electrically conductive spring pin elastically abutting the second wire-holding electrically conductive peg.

24. The electronic atomizer according to claim 23, wherein the electronic atomizer further comprises a liquid blocking plug, and the liquid blocking plug is arranged adjacent to an end portion of the battery post, and the liquid blocking plug is located in the central tube and is elastically connected to the central tube; and an end portion of the liquid blocking plug that is located in the central tube and the internal wall of the central tube jointly enclose and define a liquid collection trough to collect and block a condensate liquid;

the liquid blocking plug is formed with an overflow hole, and the first electrically conductive wire line and the second electrically conductive wire line are both extended into the overflow hole, and the battery post is formed, in an interior thereof, with a gas ingress flow passage, and the gas ingress flow passage is in communication with the overflow hole, and the electronic atomizer further comprises a liquid absorption cotton, and the liquid absorption cotton is located in the central tube and is connected to the central tube, and the liquid absorption cotton abuts the liquid blocking plug, and the liquid absorption cotton is formed with a first flow-passing line-holding slot and a second flow-passing line-holding slot, and the first electrically conductive wire line penetrates through the first flow-passing line-holding slot to contact with the liquid absorption cotton, and the second electrically conductive wire line penetrates through the second flow-passing line-holding slot to contact with the liquid absorption cotton; and the battery post is formed, at a location corresponding to the overflow hole, with a liquid receiving trough, and the overflow hole is located above the liquid receiving trough, and the battery post is in contact engagement with the liquid blocking plug, and a gas passage slit is formed in an end surface of the battery post, and the gas passage slit is in communication with the gas ingress flow passage and the liquid receiving trough.

25. An electronic atomizer, comprising a liquid-conducting atomization mechanism which comprises a vertical ceramic member and a heating screen plate assembly, wherein the vertical ceramic member comprises a liquid receiving portion and a liquid conduction mounting portion that are connected to each other, and connection between the liquid conduction mounting portion and the liquid receiving portion is a connection plane, and an atomization gas exit surface is formed on an outside of the liquid conduction mounting portion; and the heating screen plate assembly comprises a heating portion which is embedded in the atomization gas exit surface;

wherein the electronic atomizer further comprises a battery post, a central tube and a liquid storage member;

wherein the electronic atomizer further comprises a first electrically conductive spring pin, a first wire-holding electrically conductive peg and a first electrically conductive wire line, and an end portion of the liquid storage member that is adjacent to the battery post is formed with a first wire-holding assembling slot, and one end of the first electrically conductive wire line is received in the first wire-holding assembling slot, and the first wire-holding electrically conductive peg is located in the first wire-holding assembling slot and is fixedly connect to the liquid storage member, and an opposite end of the first electrically conductive wire line is located in the central tube and is soldered to a positive conductive terminal, the first electrically conductive spring pin elastically abutting the first wire-holding electrically conductive peg; and the electronic atomizer further comprises a second electrically conductive spring pin, a second wire-holding electrically conductive peg and a second electrically conductive wire line, and the end portion of the liquid storage member that is adjacent to the battery post is formed with a second wire-holding assembling slot, and one end of the second electrically conductive wire line is received in the second wire-holding assembling slot, and the second wire-holding electrically conductive peg is located in the second wire-holding assembling slot and is fixedly connect to the liquid storage member, and an opposite end of the second electrically conductive wire line is located in the central tube and is soldered to a negative conductive terminal, the second electrically conductive spring pin elastically abutting the second wire-holding electrically conductive peg.

* * * * *